US010490902B2

(12) United States Patent
Yen et al.

(10) Patent No.: US 10,490,902 B2
(45) Date of Patent: Nov. 26, 2019

(54) MOBILE DEVICE

(71) Applicant: Acer Incorporated, New Taipei (TW)

(72) Inventors: Ming-Ching Yen, New Taipei (TW); Kun-Sheng Chang, New Taipei (TW); Chien-Wen Chen, New Taipei (TW); Ching-Chi Lin, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 0 days.

(21) Appl. No.: 15/886,026

(22) Filed: Feb. 1, 2018

(65) Prior Publication Data

US 2019/0006764 A1 Jan. 3, 2019

(30) Foreign Application Priority Data

Jun. 30, 2017 (TW) ..... 106121976 A

(51) Int. Cl.
*H01Q 1/36* (2006.01)
*H01Q 13/10* (2006.01)
(Continued)

(52) U.S. Cl.
CPC ..... *H01Q 13/10* (2013.01); *H01Q 1/2266* (2013.01); *H01Q 1/2291* (2013.01); *H01Q 1/243* (2013.01); *H01Q 1/38* (2013.01); *H01Q 1/48* (2013.01); *H01Q 5/342* (2015.01); *H01Q 5/378* (2015.01); *H01Q 13/106* (2013.01); *H01Q 21/28* (2013.01); *H01Q 1/2258* (2013.01)

(58) Field of Classification Search
CPC ..... H01Q 13/10; H01Q 5/342; H01Q 5/378; H01Q 1/2266; H01Q 1/2291; H01Q 1/243; H01Q 1/38; H01Q 1/48; H01Q 13/106; H01Q 21/28; H01Q 1/2258
See application file for complete search history.

(56) References Cited

U.S. PATENT DOCUMENTS 9,502,775 B1 * 11/2016 Gummalla ..... H01Q 13/10
2006/0050000 A1 * 3/2006 Hirabayashi ..... H01Q 1/2275 343/725

(Continued)

FOREIGN PATENT DOCUMENTS

TW 201703350 A 1/2017

OTHER PUBLICATIONS

Chinese language office action dated Jun. 28, 2018, issued in application No. TW 106121976.

*Primary Examiner* — Daniel Munoz
*Assistant Examiner* — Bamidele A Jegede
(74) *Attorney, Agent, or Firm* — McClure, Qualey & Rodack, LLP

(57) ABSTRACT

A mobile device includes a metal mechanism element, a ground plane, a feeding element, a parasitic element, and a dielectric substrate. The metal mechanism element has a slot. The ground plane is coupled to the metal mechanism element. The feeding element is coupled to a signal source. The feeding element extends across the slot. The parasitic element is coupled to the ground plane. The parasitic element extends across the slot. The ground plane, the feeding element, and the parasitic element are disposed on the dielectric substrate. An antenna structure is formed by the feeding element, the parasitic element, and the slot of the metal mechanism element.

9 Claims, 8 Drawing Sheets

(51) Int. Cl.

| | |
|---|---|
| ***H01Q 5/378*** | (2015.01) |
| ***H01Q 1/22*** | (2006.01) |
| ***H01Q 1/24*** | (2006.01) |
| ***H01Q 1/38*** | (2006.01) |
| ***H01Q 1/48*** | (2006.01) |
| ***H01Q 21/28*** | (2006.01) |
| ***H01Q 5/342*** | (2015.01) |

(56) References Cited

U.S. PATENT DOCUMENTS

2009/0153407 A1* 6/2009 Zhang ..... H01Q 1/243
343/702
2009/0256757 A1* 10/2009 Chiang ..... H01Q 1/2266
343/702
2012/0007783 A1* 1/2012 Taura ..... H01Q 1/2266
343/702
2012/0229360 A1* 9/2012 Jagielski ..... H01Q 9/30
343/860
2013/0113671 A1* 5/2013 Su ..... H01Q 1/38
343/767
2013/0181871 A1* 7/2013 Eom ..... H01Q 1/243
343/702
2014/0071005 A1* 3/2014 Wang ..... H01Q 1/243
343/725
2014/0184450 A1* 7/2014 Koo ..... H01Q 5/335
343/702
2015/0236417 A1* 8/2015 Iellci ..... H01Q 1/243
343/850
2015/0338523 A1* 11/2015 Rajagopalan ..... G01S 19/36
342/357.77
2016/0294046 A1* 10/2016 Hsieh ..... H01Q 1/243
2016/0294067 A1* 10/2016 Chang ..... H01Q 13/18
2017/0005414 A1* 1/2017 Yang ..... H01Q 13/10
2017/0054196 A1* 2/2017 Hu ..... H01Q 1/243

* cited by examiner

400

MOBILE DEVICE

CROSS REFERENCE TO RELATED APPLICATIONS

This Application claims priority of Taiwan Patent Application No. 106121976 filed on Jul. 30, 2017, the entirety of which is incorporated by reference herein.

BACKGROUND OF THE INVENTION

Field of the Invention

The disclosure generally relates to a mobile device, and more particularly, to a mobile device and an antenna structure therein.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

In order to improve their appearance, designers often incorporate metal elements into mobile devices. However, the newly added metal elements tend to negatively affect the antennas used for wireless communication in mobile devices, thereby degrading the overall communication quality of the mobile devices. As a result, there is a need to propose a mobile device with a novel antenna structure, so as to overcome the problems of the prior art.

BRIEF SUMMARY OF THE INVENTION

In a preferred embodiment, the invention is directed to a mobile device including a metal mechanism element, a ground plane, a feeding element, a parasitic element, and a dielectric substrate. The metal mechanism element has a slot. The ground plane is coupled to the metal mechanism element. The feeding element is coupled to a signal source. The feeding element extends across the slot. The parasitic element is coupled to the ground plane. The parasitic element extends across the slot. The ground plane, the feeding element, and the parasitic element are disposed on the dielectric substrate. An antenna structure is formed by the feeding element, the parasitic element, and the slot of the metal mechanism element.

In some embodiments, the slot is an open slot with an open end and a closed end.

In some embodiments, the feeding element substantially has a rectangular shape.

In some embodiments, the parasitic element substantially has a straight-line shape.

In some embodiments, the antenna structure covers a low-frequency band from about 700 MHz to about 960 MHz, a first high-frequency band from about 1700 MHz to about 2400 MHz, and a second high-frequency band from about 2500 MHz to about 2900 MHz.

In some embodiments, the length of the slot is substantially equal to 0.25 wavelength of the low-frequency band.

In some embodiments, the length of the feeding element is substantially equal to 0.25 wavelength of the first high-frequency band.

In some embodiments, the length of the parasitic element is substantially equal to 0.25 wavelength of the second high-frequency band.

In some embodiments, the feeding element and the slot of the metal mechanism element are excited to generate a fundamental resonant mode, thereby forming the low-frequency band. The feeding element and the slot of the metal mechanism element are further excited to generate a higher-order resonant mode, thereby forming the first high-frequency band.

In some embodiments, the parasitic element and the slot of the metal mechanism element are excited to generate a fundamental resonant mode, thereby forming the second high-frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures of the invention will be described in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
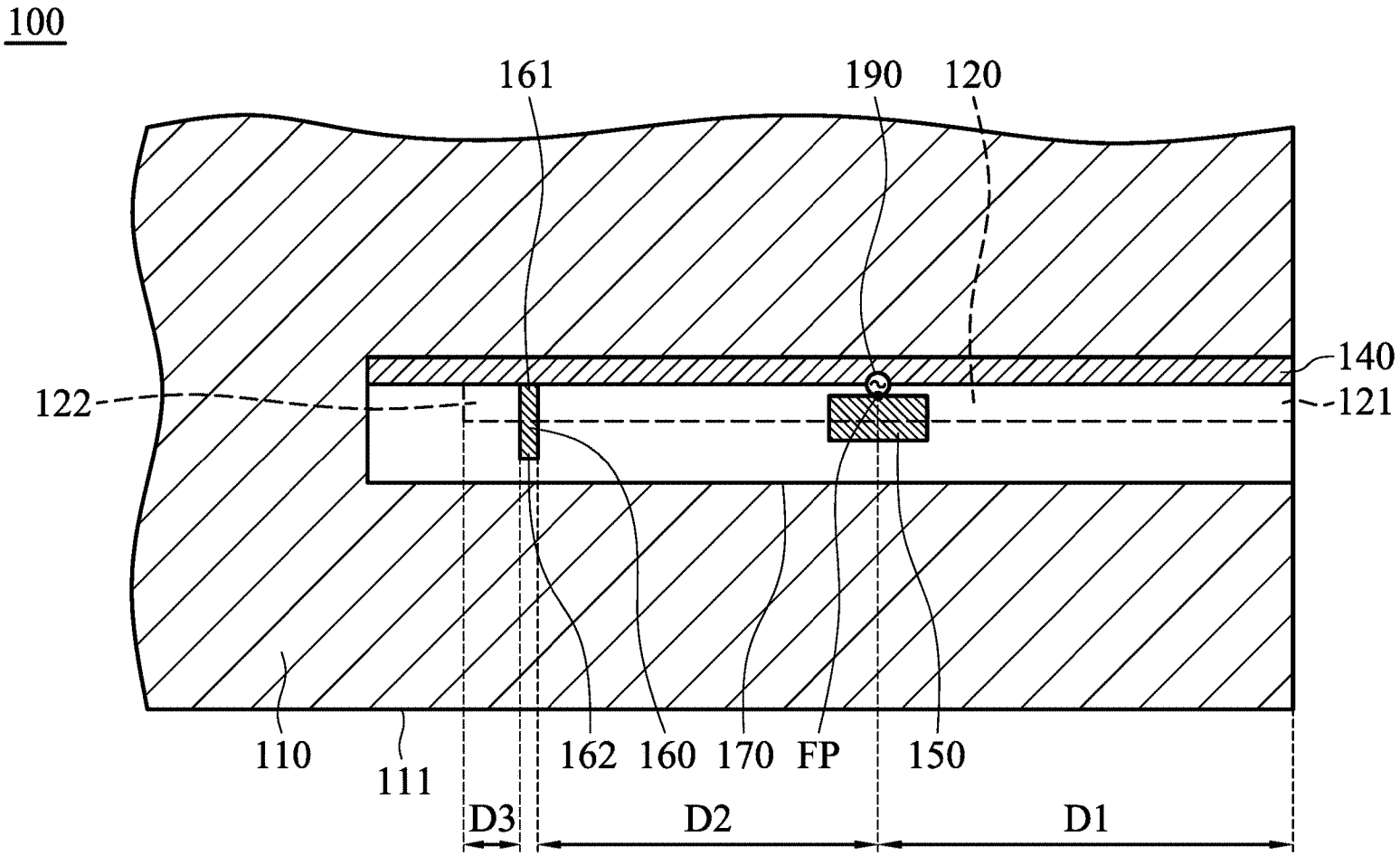
FIG. 1A is a perspective view of a mobile device according to an embodiment of the invention.
Figure 1B:
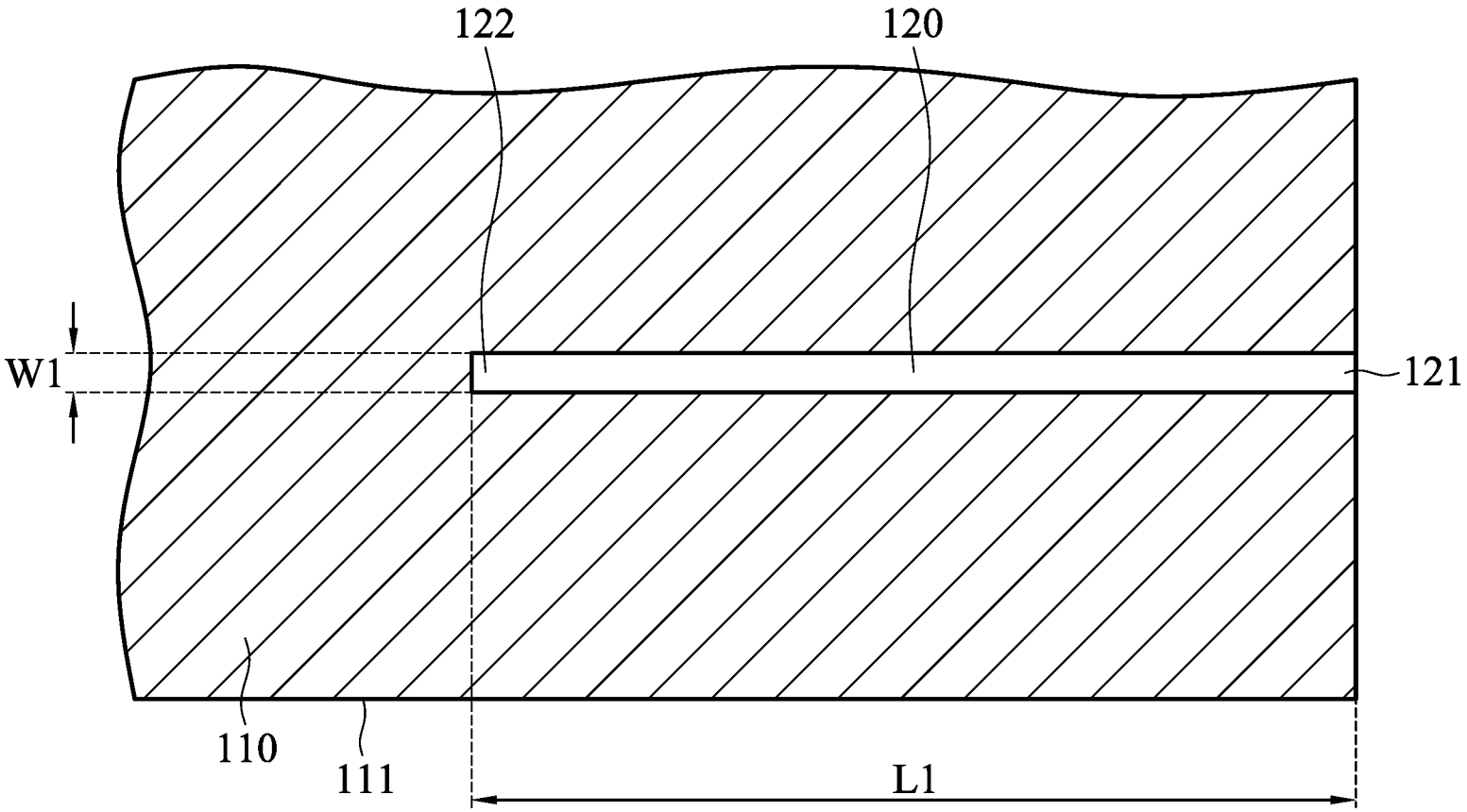
FIG. 1B is a view of a lower layer portion of a mobile device according to an embodiment of the invention.
Figure 1C:
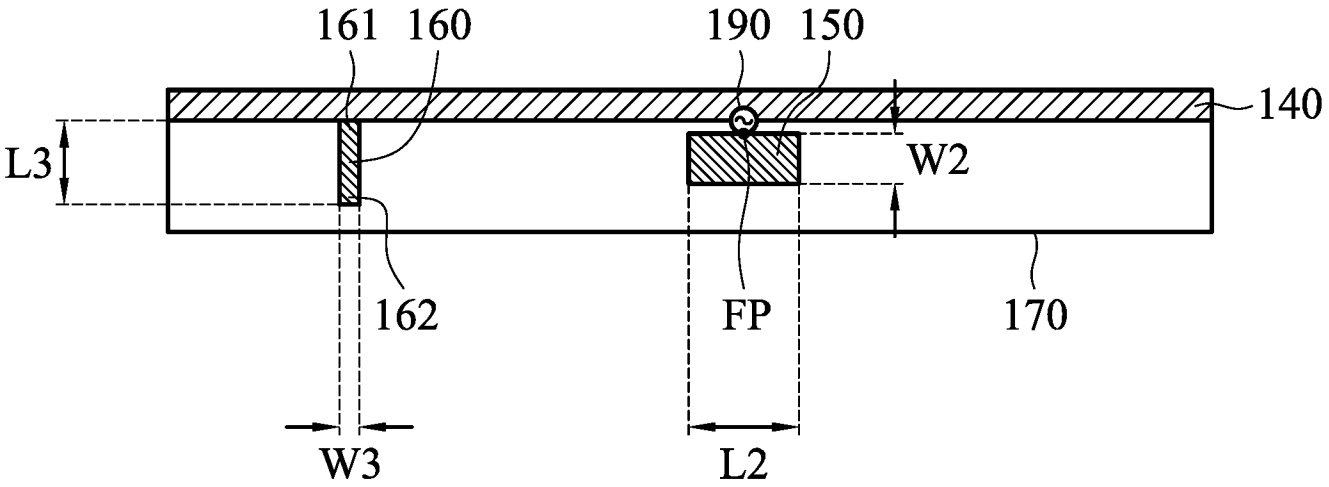
FIG. 1C is a view of an upper layer portion of a mobile device according to an embodiment of the invention.
Figure 1D:
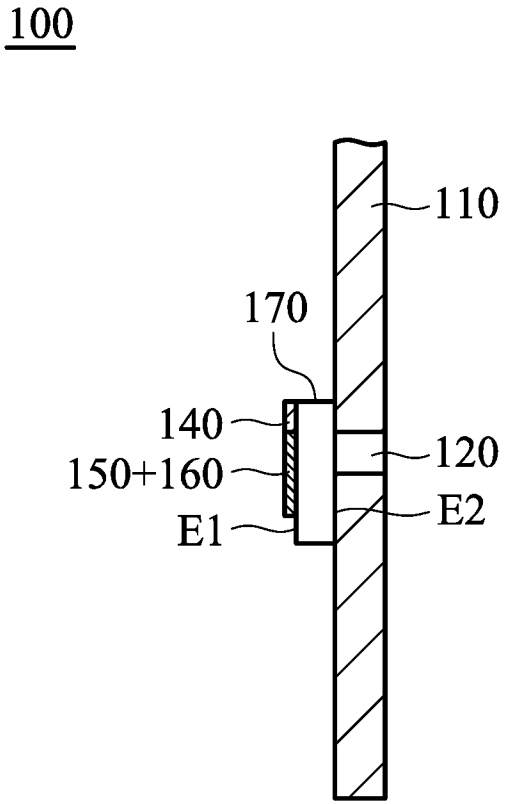
FIG. 1D is a side view of a mobile device according to an embodiment of the invention.

FIG. 1A is a perspective view of a mobile device 100 according to an embodiment of the invention. FIG. 1B is a view of a lower layer portion of the mobile device 100 according to an embodiment of the invention. FIG. 1C is a view of an upper layer portion of the mobile device 100 according to an embodiment of the invention. FIG. 1D is a side view of the mobile device 100 according to an embodiment of the invention. Please refer to FIG. 1A, FIG. 1B, FIG. 1C, and FIG. 1D together. The mobile device 100 may be a smartphone, a tablet computer, or a notebook computer. In the embodiment of FIG. 1A, FIG. 1B, FIG. 1C, and FIG. 1D, the mobile device 100 includes a metal mechanism element 110, a ground plane 140, a feeding element 150, a parasitic element 160, and a dielectric substrate 170. It should be understood that the mobile device 100 may further include other components, such as a processor, a touch control panel, a speaker, a battery module, and a housing, although they are not displayed in FIG. 1A, FIG. 1B, FIG. 1C, and FIG. 1D.

The metal mechanism element 110 may be a metal plate, and the metal plate may be an appearance element of the mobile device 100. The metal mechanism element 110 has a slot 120. The slot 120 may substantially have a straight-line shape. The slot 120 may be substantially parallel to an edge 111 of the metal mechanism element 110. Specifically, the slot 120 is an open slot, and the open slot has an open end 121 and a closed end 122 which are away from each other.

The ground plane 140, the feeding element 150, and the parasitic element 160 may be made of metal materials, such as copper, silver, aluminum, iron, or their alloys. The dielectric substrate 170 may be an FR4 (Flame Retardant 4) substrate or an FPCB (Flexible Printed Circuit Board). The dielectric substrate 170 may have a first surface E1 and a second surface E2 which are opposite to each other. The ground plane 140, the feeding element 150, and the parasitic element 160 are all disposed on the first surface E1 of the dielectric substrate 170. The second surface E2 of the dielectric substrate 170 is adjacent to the metal mechanism element 110, or is directly attached to the metal mechanism element 110 (i.e., the second surface E2 is adjacent to the slot 120, or is directly attached to the slot 120).

The ground plane 140 is coupled to the metal mechanism element 110, and they both provide a ground voltage for the mobile device 100. For example, the ground plane 140 may be a ground copper foil, which may extend from the dielectric substrate 170 onto the metal mechanism element 110. The ground plane 140 may be aligned with an edge of the slot 120.

The feeding element 150 may substantially have a rectangular shape. A feeding point FP on the feeding element 150 is coupled to a signal source 190. The signal source 190 may be an RF (Radio Frequency) module for generating a transmission signal or processing a reception signal. The feeding element 150 extends across the slot 120 of the metal mechanism element 110. For example, the feeding element 150 may have a vertical projection on the metal mechanism element 110, and the aforementioned vertical projection may be across the whole width W1 of the slot 120.

The parasitic element 160 may substantially have a straight-line shape. The parasitic element 160 has a first end 161 and a second end 162. The first end 161 of the parasitic element 160 is coupled to the ground plane 140. The second end 162 of the parasitic element 160 extends across the slot 120 of the metal mechanism element 110. For example, the parasitic element 160 may have a vertical projection on the metal mechanism element 110, and the aforementioned vertical projection may be across the whole width W1 of the slot 120.

In a preferred embodiment, an antenna structure is formed by the feeding element 150, the parasitic element 160, and the slot 120 of the metal mechanism element 110, and its characteristics will be described in the following embodiments.

Figure 2:
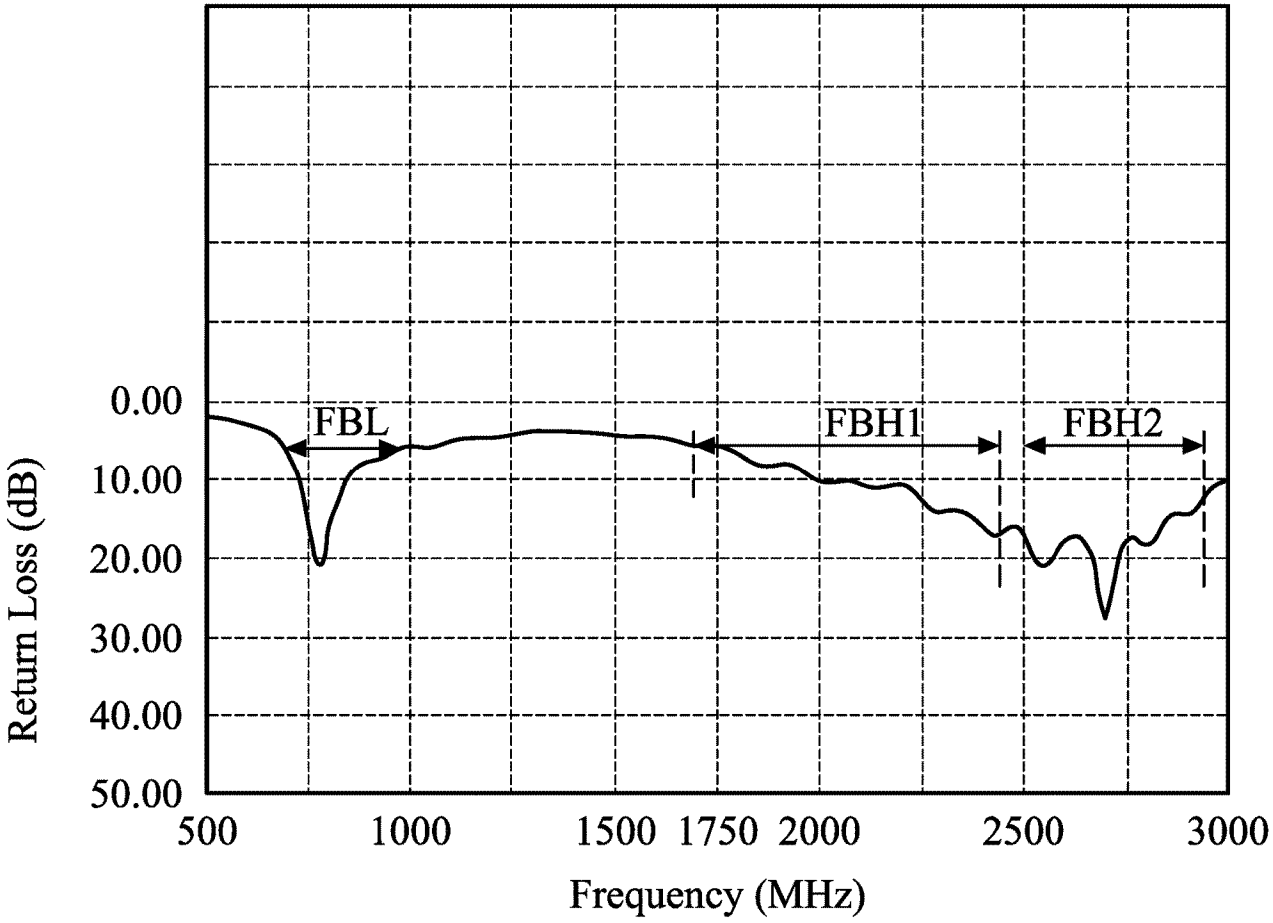
FIG. 2 is a diagram of return loss of an antenna structure of a mobile device according to an embodiment of the invention.

FIG. 2 is a diagram of return loss of the antenna structure of the mobile device 100 according to an embodiment of the invention. The horizontal axis represents the operation frequency (MHz), and the vertical axis represents the return loss (dB). According to the measurement of FIG. 2, when transmitting or receiving wireless signals, the antenna structure of the mobile device 100 can cover a low-frequency band FBL, a first high-frequency band FBH1, and a second high-frequency band FBH2. The low-frequency band FBL may be from about 700 MHz to about 960 MHz. The first high-frequency band FBH1 may be from about 1700 MHz to about 2400 MHz. The second high-frequency band FBH2 may be from about 2500 MHz to about 2900 MHz. Therefore, the antenna structure of the mobile device 100 can at least support the multiband and wideband operations of LTE (Long Term Evolution), GSM (Global System for Mobile Communication), and WLAN (Wireless Local Area Networks).

In some embodiments, the operation principles of the antenna structure of the mobile device 100 are as follows. The feeding element 150 and the whole slot 120 of the metal mechanism element 110 are excited to generate a fundamental resonant mode, thereby forming the aforementioned low-frequency band FBL. The parasitic element 160 and the slot 120 of the metal mechanism element 110 are excited to generate another fundamental resonant mode, thereby forming the aforementioned second high-frequency band FBH2. Specifically, the second high-frequency band FBH2 is merely excited by the parasitic element 160 and a left half-portion of the slot 120. The left half-portion of the slot 120 is positioned between the closed end 122 of the slot 120 and the feeding element 150, and it is considered as a virtual closed slot. In other words, a right half-portion of the slot 120 (between the feeding element 150 and the open end 121 of the slot 120) does not contribute to the generation of the second high-frequency band FBH2. The feeding element 150 and the whole slot 120 of the metal mechanism element 110 are further excited to generate a higher-order resonant mode (triple frequency), thereby forming aforementioned the first high-frequency band FBH1. Such a design can effectively reduce the total area of the antenna structure of the mobile device 100 since the low-frequency band FBL, the first high-frequency band FBH1, and the second high-frequency band FBH2 at least partially share the same resonant path.

In some embodiments, the element sizes of the mobile device 100 are as follows. The length L1 of the slot 120 is substantially equal to 0.25 wavelength ($\lambda/4$) of the low-frequency band FBL. The width W1 of the slot 120 is about 3 mm. The length L2 of the feeding element 150 is substantially equal to 0.25 wavelength ($\lambda/4$) of the first high-frequency band FBH1. The width W2 of the feeding element 150 is from about 4 mm to about 5 mm. The length L3 of the parasitic element 160 is substantially equal to 0.25 wavelength ($\lambda/4$) of the second high-frequency band FBH2. The width W3 of the parasitic element 160 is smaller than 2 mm. The distance D1 between the feeding point FP of the feeding element 150 and the open end 121 of the slot 120 is substantially equal to 0.125 wavelength ($\lambda/8$) of the low-frequency band FBL. That is, the feeding point FP of the feeding element 150 may be substantially positioned at a central point of the slot 120. The distance D2 between the feeding point FP of the feeding element 150 and the parasitic element 160 is greater than the distance D3 between the parasitic element 160 and the closed end 122 of the slot 120. For example, the distance D2 is approximately 2.5 times the distance D3. The above ranges of element sizes are calculated and obtained according to many experiment results, and they help to optimize the operation frequency band and the impedance matching of the antenna structure of the mobile device 100.

Figure 3:
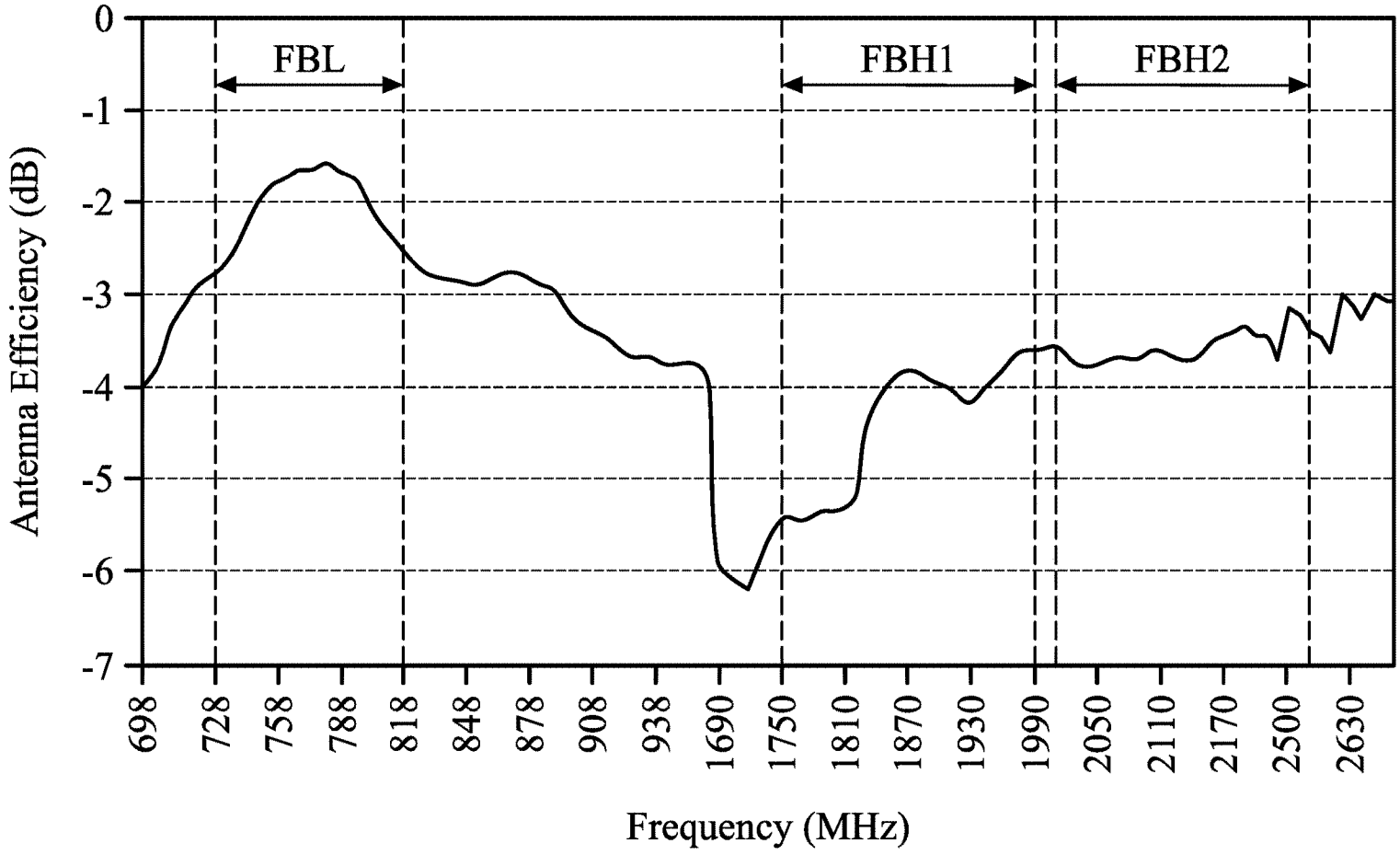
FIG. 3 is a diagram of antenna efficiency of an antenna structure of a mobile device according to an embodiment of the invention.

FIG. 3 is a diagram of antenna efficiency of the antenna structure of the mobile device 100 according to an embodiment of the invention. The horizontal axis represents the operation frequency (MHz), and the vertical axis represents the antenna efficiency (dB). According to the measurement of FIG. 3, the antenna efficiency of the antenna structure of the mobile device 100 is about −1.5 dB in the low-frequency band FBL, and the antenna efficiency of the antenna structure of the mobile device 100 is about −3.5 dB in the first high-frequency band FBH1 and the second high-frequency band FBH2. This meets the practical requirements of application in general mobile communication devices.

Figure 4A:
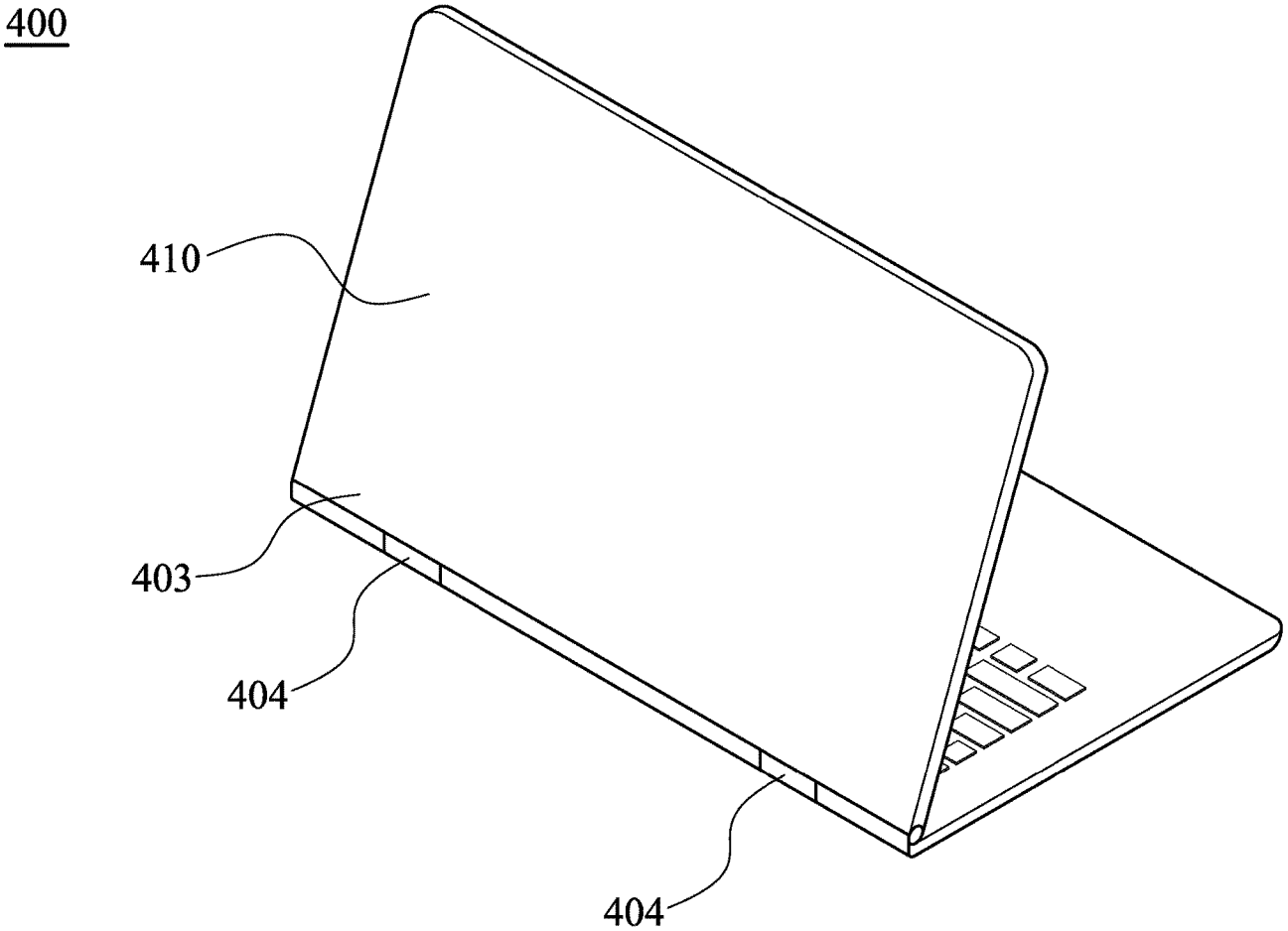
FIG. 4A is a view of a mobile device according to an embodiment of the invention.

FIG. 4A is a view of a mobile device 400 according to an embodiment of the invention. In the embodiment of FIG. 4A, the mobile device 400 is a notebook computer, and the aforementioned metal mechanism element 110 is an upper cover housing 410 of the notebook computer (i.e., the so-called "A component" of the notebook computer). If the aforementioned antenna structure is implemented with the upper cover housing 410 of the notebook computer, the slot 120 may be adjacent to a hinge 404 of the notebook computer. That is, the slot 120 may be formed at a first position 403 of the upper cover housing 410.

Figure 4B:
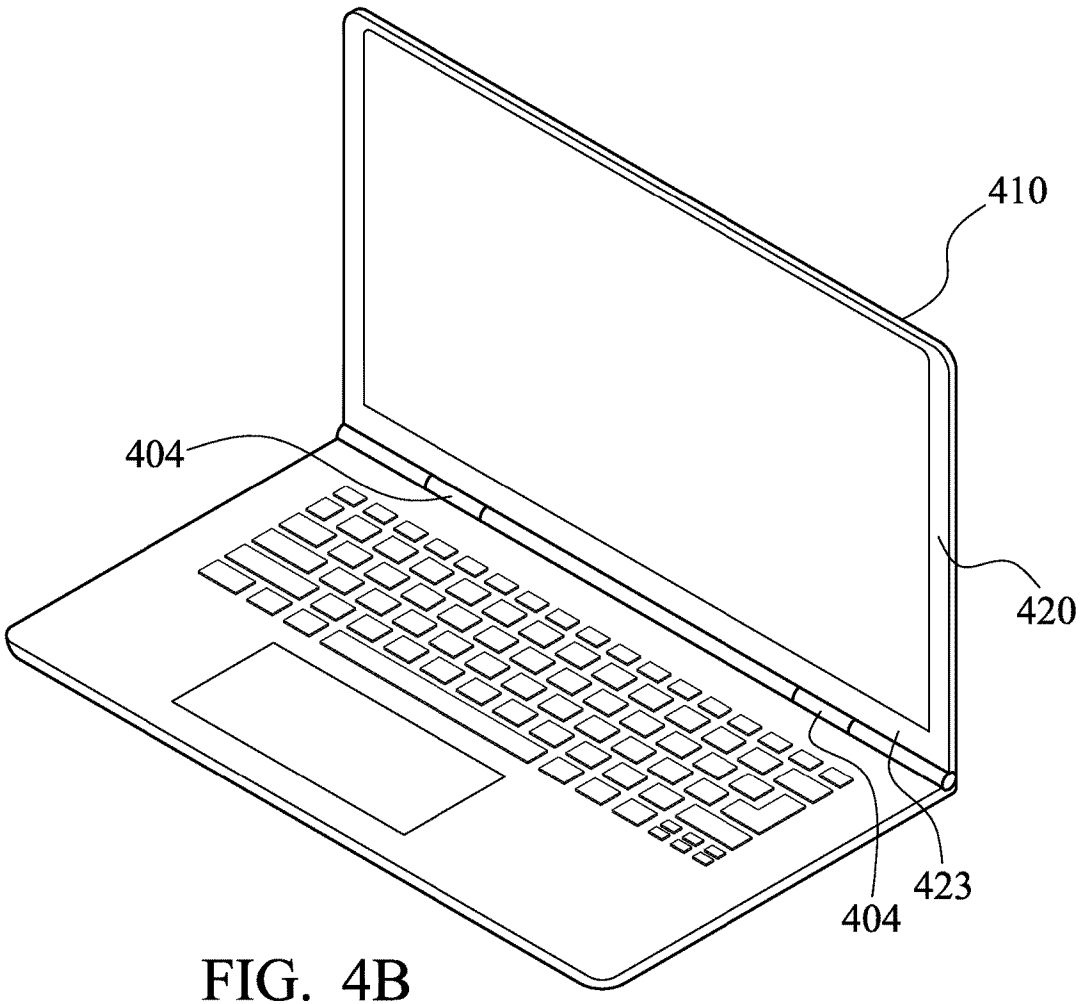
FIG. 4B is a view of a mobile device according to another embodiment of the invention.

FIG. 4B is a view of the mobile device 400 according to another embodiment of the invention. In the embodiment of FIG. 4B, the mobile device 400 is a notebook computer, and the aforementioned metal mechanism element 110 is a display frame 420 of the notebook computer (i.e., the so-called "B component" of the notebook computer). If the aforementioned antenna structure is implemented with the display frame 420 of the notebook computer, the slot 120 may be adjacent to a hinge 404 of the notebook computer. That is, the slot 120 may be formed at a second position 423 of the display frame 420.

The aforementioned antenna structure can cover the LTE wide operation frequency bands and provide sufficient antenna efficiency, regardless of the antenna structure positioned at either the first position 403 of the upper cover housing 410 or the second position 423 of the display frame 420. It should be noted that one of the upper cover housing 410 and the display frame 420 may be made of a metal material (forming the antenna structure), and the other of the upper cover housing 410 and the display frame 420 may be made of a nonconductive material, so as to avoid the interference with the radiation pattern of the antenna structure. Alternatively, if the upper cover housing 410 and the display frame 420 are both made of metal materials, the display frame 420 should have an opening, and the vertical projection of the opening should be substantially aligned with the antenna structure of the upper cover housing 410, such that the electromagnetic waves of the antenna structure can be transmitted through the opening. Since the antenna structure is adjacent to the hinge 404 of the notebook computer, it does not occupy the space at the top side of the display device. Accordingly, the proposed design is suitable for application in a variety of notebook computer products with narrow borders.

The invention proposes a novel antenna structure, which uses only one slot for covering wideband operations. When the antenna structure is applied to a mobile device including a metal back cover (e.g., an upper cover housing made of a metal material), it effectively prevents the metal back cover from negatively affecting the communication quality of the mobile device because the metal back cover is considered as an extension portion of the antenna structure. It should be also noted that the invention can improve the appearance and design of the mobile device, without opening any antenna windows on the metal back cover. In conclusion, the invention has the advantages of small size, wide bandwidth, and beautiful device appearance, and therefore it is suitable for application in a variety of mobile communication devices.

Note that the above element sizes, element shapes, and frequency ranges are not limitations of the invention. An antenna designer can fine-tune these settings or values according to different requirements. It should be understood that the mobile device and the antenna structure of the invention are not limited to the configurations of FIGS. 1-4. The invention may include any one or more features of any one or more embodiments of FIGS. 1-4. In other words, not all of the features displayed in the figures should be implemented in the mobile device and the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A mobile device, comprising:

a metal mechanism element, having a slot;

a ground plane, coupled to the metal mechanism element;

a feeding element, having a feeding point coupled to a signal source, wherein the feeding element extends across the slot;

a parasitic element, coupled to the ground plane, wherein the parasitic element extends across the slot; and a dielectric substrate, wherein the ground plane, the feeding element, and the parasitic element are disposed on the dielectric substrate;

wherein an antenna structure is formed by the feeding element, the parasitic element, and the slot of the metal mechanism element;

wherein the slot is an open slot with an open end and a closed end;

wherein the antenna structure covers a low-frequency band from about 700 MHz to about 960 MHz;

wherein a distance between the feeding point of the feeding element and the open end of the slot is substantially equal to 0.125 wavelength of the low-frequency band.

2. The mobile device as claimed in claim 1, wherein the feeding element substantially has a rectangular shape.

3. The mobile device as claimed in claim 1, wherein the parasitic element substantially has a straight-line shape.

4. The mobile device as claimed in claim 1, wherein the antenna structure further covers a first high-frequency band from about 1700 MHz to about 2400 MHz, and a second high-frequency band from about 2500 MHz to about 2900 MHz.

5. The mobile device as claimed in claim 4, wherein a length of the slot is substantially equal to 0.25 wavelength of the low-frequency band.

6. The mobile device as claimed in claim 4, wherein a length of the feeding element is substantially equal to 0.25 wavelength of the first high-frequency band.

7. The mobile device as claimed in claim 4, wherein a length of the parasitic element is substantially equal to 0.25 wavelength of the second high-frequency band.

8. The mobile device as claimed in claim 4, wherein the feeding element and the slot of the metal mechanism element are excited to generate a fundamental resonant mode, thereby forming the low-frequency band, and wherein the feeding element and the slot of the metal mechanism element are further excited to generate a higher-order resonant mode, thereby forming the first high-frequency band.

9. The mobile device as claimed in claim 4, wherein the parasitic element and the slot of the metal mechanism element are excited to generate a fundamental resonant mode, thereby forming the second high-frequency band.

* * * * *